US007604121B1

(12) United States Patent
Tang et al.

(10) Patent No.: US 7,604,121 B1
(45) Date of Patent: Oct. 20, 2009

(54) STRUCTURE FOR FRAGILE PLATE PACKAGING AND PROTECTION DEVICE

(75) Inventors: Yi-Lung Tang, Taipei (TW); Huang-Sheng Liu, Taipei (TW); Shang-Yi Hsu, Taipei (TW)

(73) Assignee: Sun Well Solar Corporation, Taipei (TW)

( * ) Notice: Subject to any disclaimer, the term of this patent is extended or adjusted under 35 U.S.C. 154(b) by 0 days.

(21) Appl. No.: 12/339,162

(22) Filed: Dec. 19, 2008

(30) Foreign Application Priority Data

Oct. 30, 2008 (CN) ..... 2008 2 0139676 U

(51) Int. Cl.
*B65D 85/48* (2006.01)

(52) U.S. Cl. ..... 206/454; 206/587; 206/594

(58) Field of Classification Search ..... 206/454, 206/455, 456, 445, 449, 451, 711, 594, 591, 206/592, 593, 587
See application file for complete search history.

(56) References Cited

U.S. PATENT DOCUMENTS 5,570,856 A * 11/1996 Sharpe ..... 242/588.3
5,605,246 A * 2/1997 Rausch et al. ..... 220/555
5,833,067 A * 11/1998 Joshi ..... 206/454

* cited by examiner

*Primary Examiner*—Jacob K Ackun, Jr.
(74) *Attorney, Agent, or Firm*—Ming Chow Chow; Sinorica, LLC

(57) ABSTRACT

Disclosed is an improved structure for a fragile plate packaging and protection device, comprising: a box main body provided with an accommodating space, a bottom plate, two first fixing elements, two second fixing elements, and a plurality of buffer elements having gaps. Wherein, said bottom plate is provided in said accommodating space of said box main body, and is in contact with a bottom portion of said box main body; said two first fixing elements are provided in said accommodating space of said box main body face-to-face, and are disposed vertically at a bottom portion of said box main body; said two second fixing elements are disposed on said two first fixing elements respectively, thus ensuring better safety protection of said fragile plate in said box main body during transportation.

10 Claims, 8 Drawing Sheets

STRUCTURE FOR FRAGILE PLATE PACKAGING AND PROTECTION DEVICE

BACKGROUND OF THE INVENTION

1. Field of the Invention

The present invention relates to an improved structure for fragile plate packaging and protection device, and in particular to a packaging box capable of accommodating fragile plates of various sizes, and having better carrying and protection capability, so as to prevent damages of fragile plates in a positive manner.

2. The Prior Arts

In general, the transportation of an ordinary fragile plate, such as a glass substrate, a liquid crystal panel, a solar energy module plate, or a plasma display panel glass substrate is realized through a box main body having a very good shock-proof and buffering capability to provide sufficient protection, so as to reduce the possibility that the fragile plate may be damaged or even be broken during its transportation.

Referring to FIG. 1 for a packaging box structure of a kind of fragile plate according to the prior art. As shown in FIG. 1, such a packaging box structure includes: a box main body 10, and a box cover 11, the box main body 10 and the box cover 11 are made of a plastic foaming material. Wherein, a protection plate 12 is provided each correspondingly on both sides of the box main body 10, and a plurality of insertion slots 13 are provided on the protection plate 12. Each of the insertion slots 13 is used to embed a fragile plate, thus providing the positioning and protection functions for a fragile plate during transportation. However, for a conventional packaging box structure of fragile plates as shown in FIG. 1, since a protection plate 12 is formed directly on a box main body 10, thus it will be very uneconomical that, the entire box main body must be replaced when insertion slots 13 are damaged or are unable to effectively hold the fragile plates. Meanwhile, since this kind of design is not fit for transporting fragile plates of various different sizes, therefore, transportation boxes of various sizes must be prepared, hereby resulting in an increase of cost of transportation.

Therefore, another kind of transportation box is proposed that its protection plate can be installed separately and it fits for various sizes of fragile plates. Referring to FIG. 2 for a transportation box of a glass substrate as disclosed in Patent Publication Number 456363 of Taiwan, ROC. As shown in FIG. 2, a glass substrate transportation box 20 includes a box main body 21, a removable slot insertion plate 22, and a removable slot insertion plate stand 23. The removable slot insertion plate 22 and the removable slot insertion plate stand 23 are each provided with a plurality of fixing slots 25. As such, through the plurality of insertion slots 25 disposed on the removable slot insertion plate 22 and the removable slot insertion plate stand 23 for securing the fragile plates, and by utilizing insertion slots 24 that are used to receive the inserted removable slot insertion plates at various portions of a box main body, though this kind of arrangement may improve the shortcomings of the prior art as shown in FIG. 1 that protection plates 12 are formed directly on a box main body 10, so that the entire box main body has to be replaced, when the insertion slots 13 are damaged or are not able to hold glass substrates effectively. Moreover, this kind of design and arrangement are suitable for transporting fragile plates of various sizes.

However, regardless of the design that the protection plate 12 as shown in FIG. 1 or the removable slot insertion plate 22 as shown in FIG. 2 is an integrally formed or a separable protection plate structure, yet in both the cases, the insertion slots are mainly used to hold and fix fragile plates effectively, thus when the gaps between insertion slots are getting overly large, then the insertion slots are not able to hold and fix the fragile plates stably, and thus is liable to cause vibrations during the process of fragile plate transportation, in addition, there exists no buffer protection structure in contact with fragile plates, thus increasing the possibility of its being damaged. In particular, the four corners of a fragile plate are most vulnerable to the vibrations, and therefore are liable to be damaged first.

SUMMARY OF THE INVENTION

In view of the shortcomings and drawbacks of the packaging box of fragile plates of the prior art, the present invention provides an improved structure for a fragile plate packaging box capable of providing better carrying capability and safety protection, thus providing sufficient protection for fragile plates, reducing the damage rate, and promoting further the progress and development of this industry.

An objective of the present invention is to provide an improved structure for a packaging and protection device of fragile plates, and that is achieved through a plurality of buffer elements embedded respectively in a bottom portion of a first fixing slot, and in a top portion of a second fixing slot, so as to overcome the problem that the gaps between the fixing slots are too large to hold and fix the fragile plates stably, and thus are liable to cause vibrations of fragile plates during transportation. As such, raising the safety of fragile plates in piling, mounting & dismounting, and transportation processes in a positive manner.

Another objective of the present invention is to provide an improved structure for a packaging and protection device of fragile plates, that is capable of effectively dissipating the vibration forces incurred during the piling, mounting & dismounting, or transportation process, and preventing any possible damage of a fragile plate at its four corners, through tight contact between a bottom plate, a positioning strip, buffer elements, and a bottom surface, a top surface, two side surfaces of a fragile plate respectively.

Still another objective of the present invention is to provide an improved structure for a packaging and protection device of fragile plates, that is capable of accommodating fragile plates of various sizes through face-to-face movements to get closer to each other, or through up-and-down movements of a first fixing element and a second fixing element. As such, the improved structure for a packaging and protection device of fragile plates of the present invention is not only convenient to use, but the value of utilization of the packaging and protection device can also be increased.

To achieve the above-mentioned objective, the present invention provides an improved structure for a packaging and protection device of fragile plates, including: a box main body, two first fixing elements, two second fixing elements, a plurality of buffer elements, and a plurality of positioning strips. Wherein, the box main body is provided with an accommodating space, and a box cover that is used to cover and close the opening of the box main body, and the box cover is also provided with an accommodating space. A bottom plate is placed in the accommodating space of the box main body and is in contact with a bottom portion of the box main body, the two first fixing elements are provided vertically at the bottom portion of the accommodating space of the box main body in a face-to-face manner. The two first fixing elements are provided each with a plurality of first fixing slots, and embedded slots are placed respectively in the bottom portion of the first fixing slot. Two second fixing elements are provided over two first fixing elements vertically in a face-to-face manner, and the two second fixing elements are provided each with a plurality of second fixing slots, and a top portion of each of the second fixing slots is provided respectively with embedded slots. A plurality of positioning strips are provided in the accommodating space of a box cover and are in contact with the box cover, and each of the positioning strips is provided with a plurality of positioning slots. A plurality of buffer elements are embedded in the embedded slots of the first fixing element and the second fixing element, and the buffer elements are provided with gaps.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
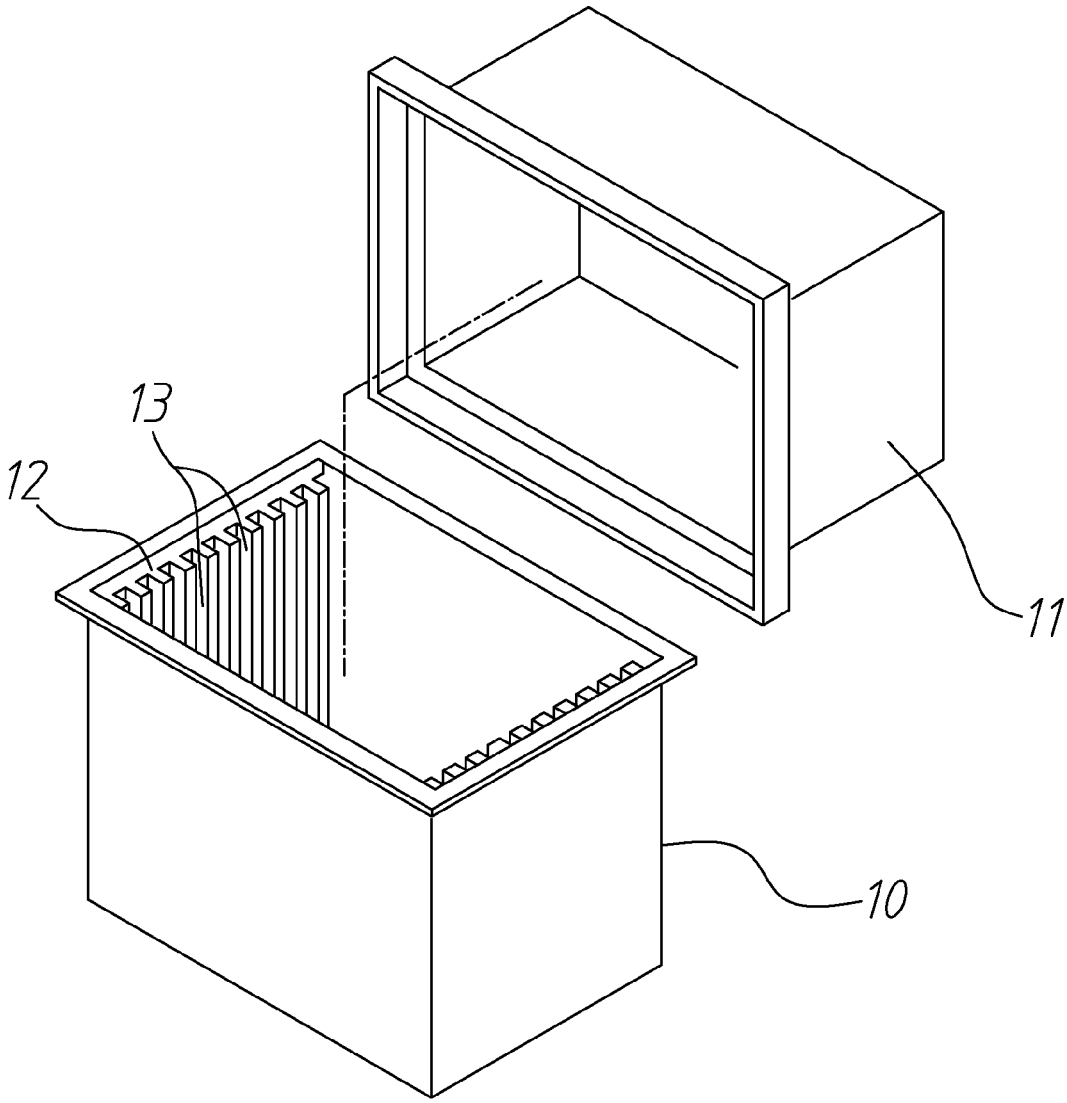
Fig. 1 (prior art)
FIG. 1 is a schematic diagram of a packaging box structure of fragile plates according to the prior art.
Figure 2:
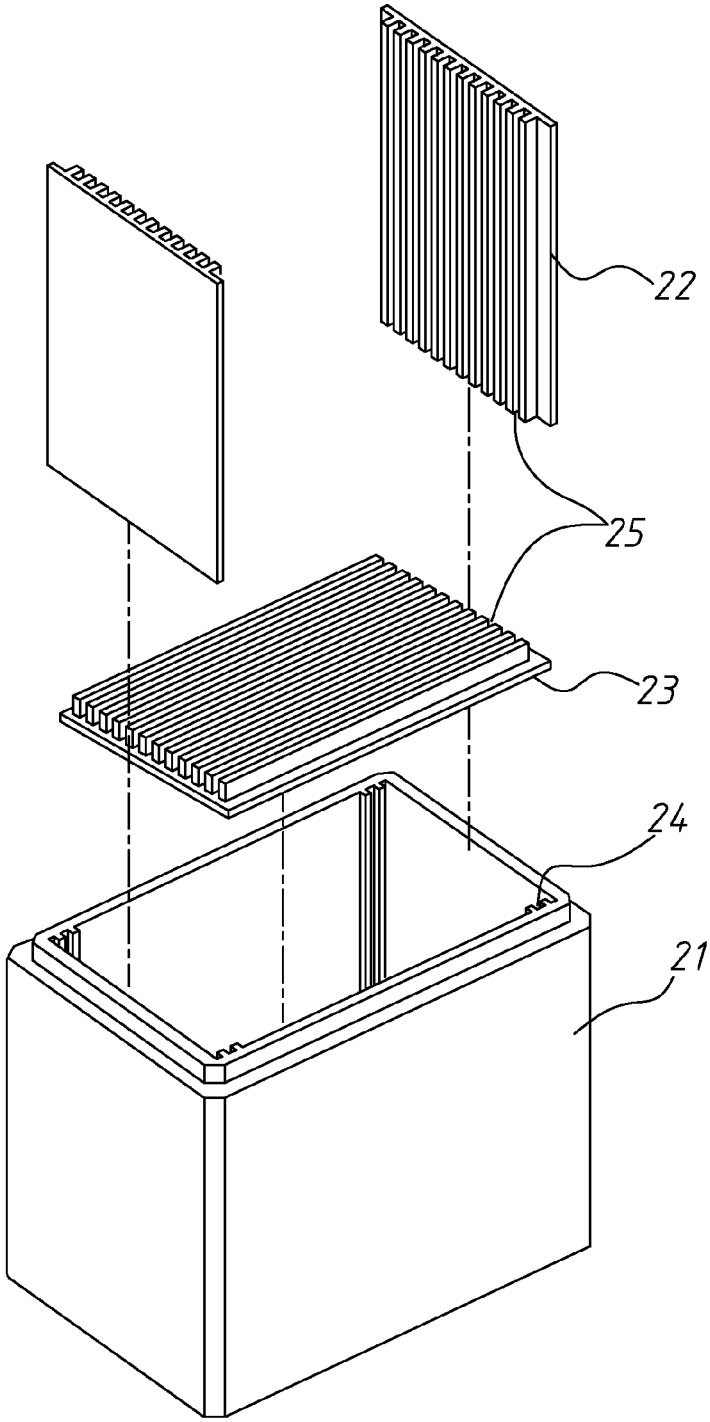
Fig. 2 (prior art)
FIG. 2 is a schematic diagram of another packaging box structure of fragile plates according to the prior art.
Figure 3:
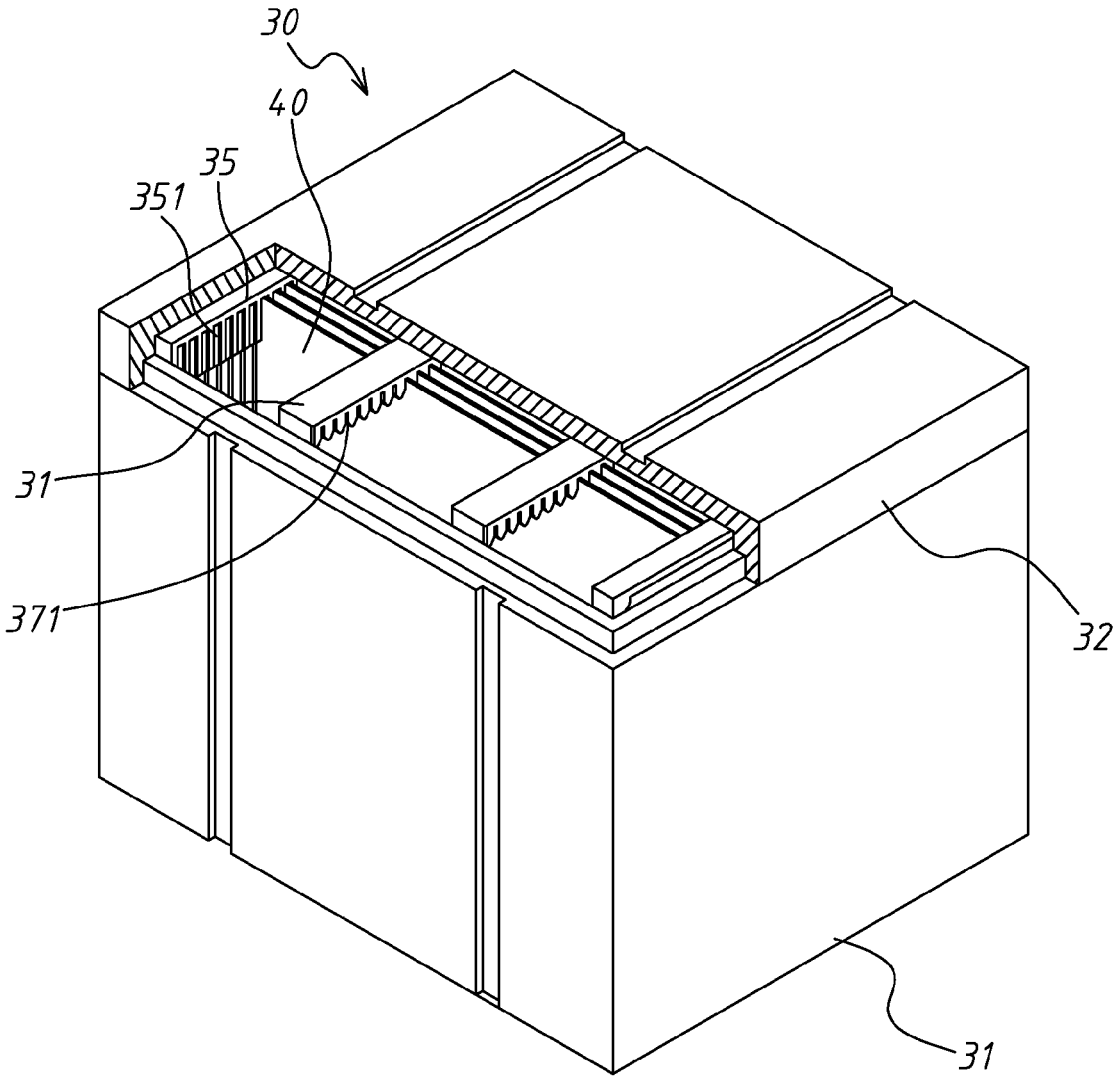
FIG. 3 is a perspective view of an improved structure for a packaging and protection device of fragile plates according to an embodiment of the present invention.
Figure 4:
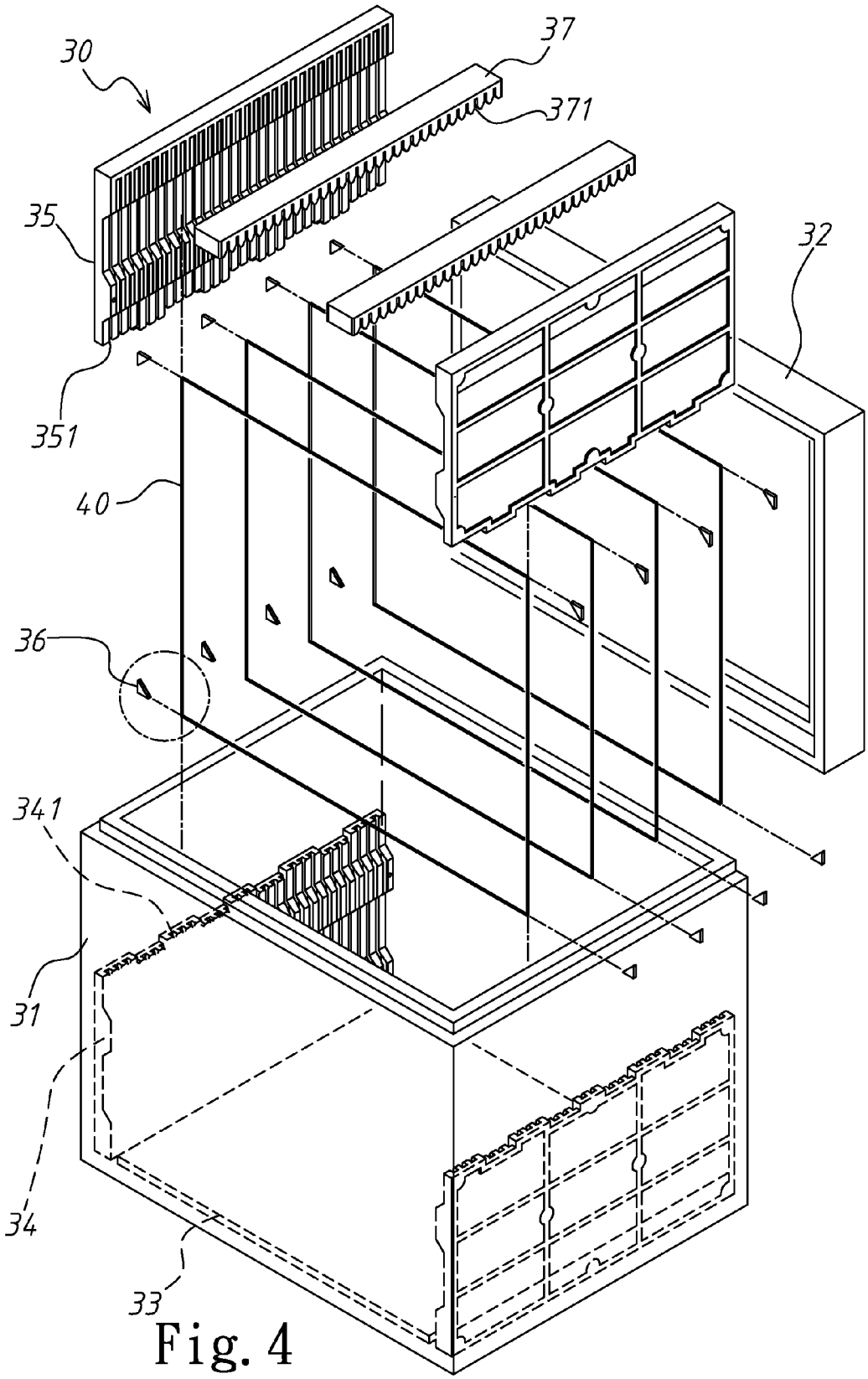
FIG. 4 is an exploded perspective view of an improved structure for packaging and protection device of fragile plates according to an embodiment of the present invention.
Figure 5:
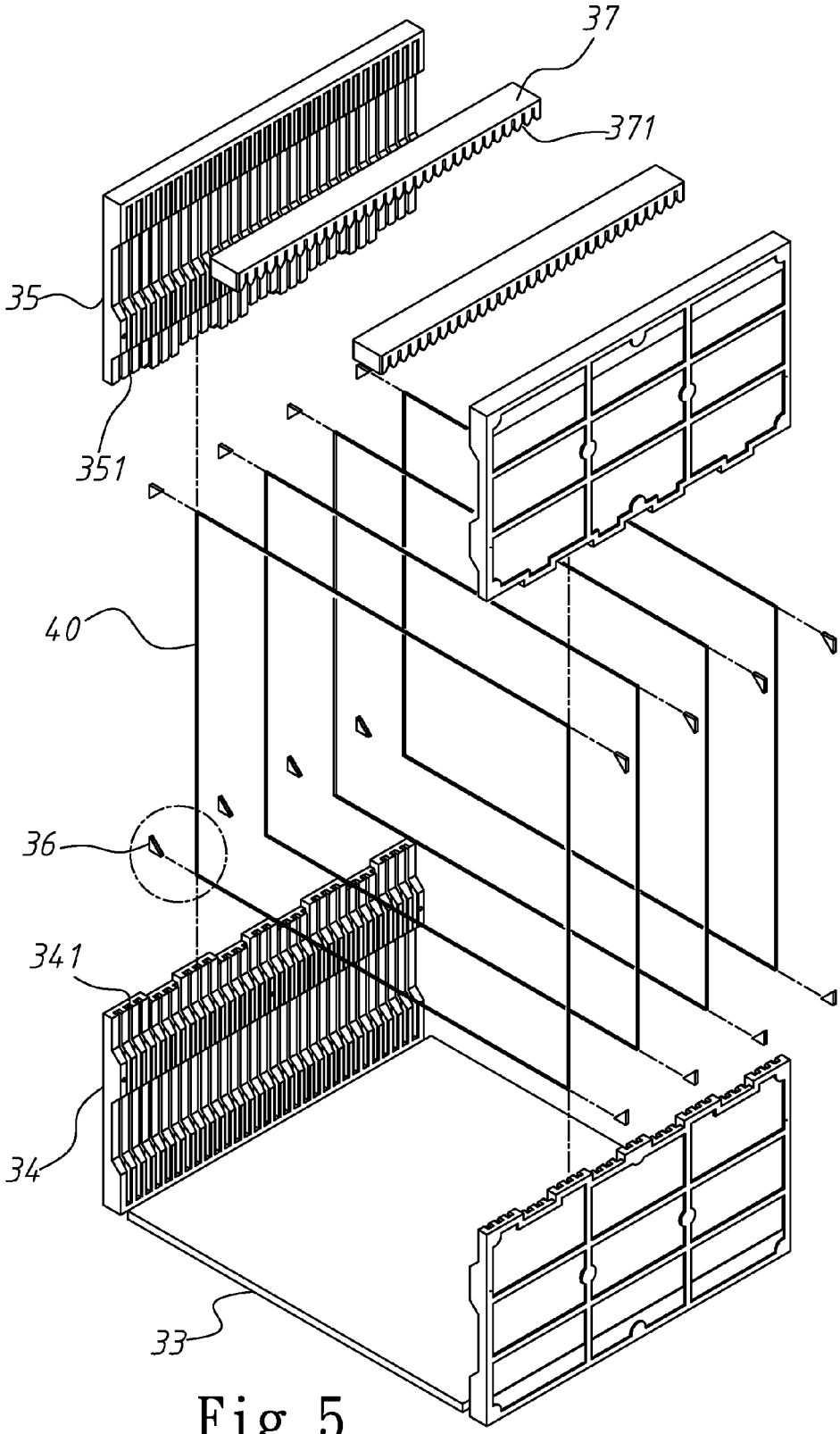
FIG. 5 is another exploded perspective view of an improved structure for a packaging and protection device of fragile plates according to an embodiment of the present invention.

Referring to FIGS. 3, 4, and 5 for a perspective, an exploded perspective, and an exploded perspective views respectively of an improved structure for a packaging and protection device of fragile plates according to an embodiment of the present invention. As shown in FIGS. 3, 4, and 5, a fragile plates packaging and protection device 30 includes: a box main body 31, a bottom plate 33, two first fixing elements 34, two second fixing elements 35, a plurality of buffer elements 36, and a plurality of positioning strips 37.

Figure 6:
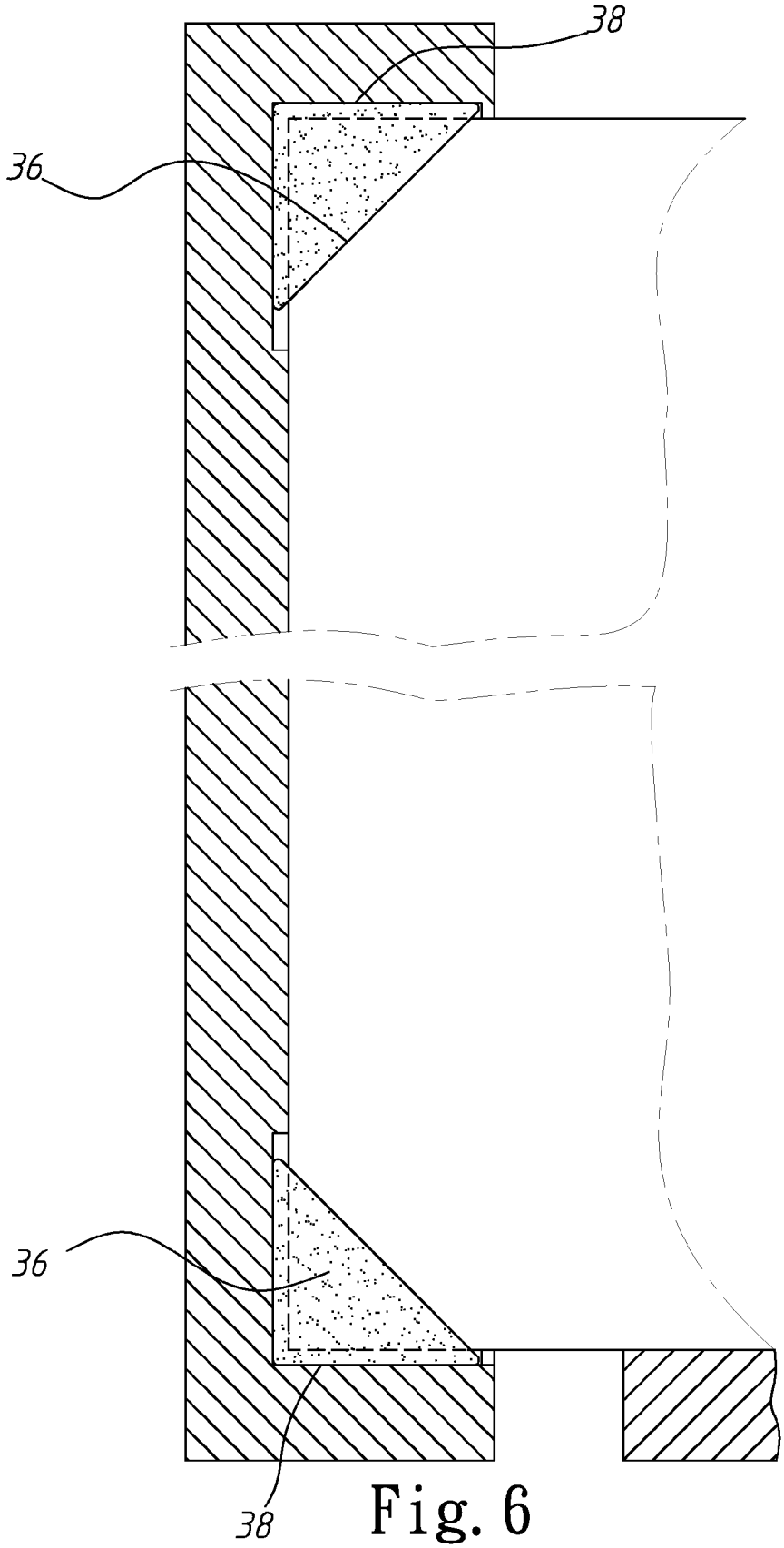
FIG. 6 is a cross section view of an improved structure for a packaging and protection device of fragile plates according to an embodiment of the present invention.
Figure 7:
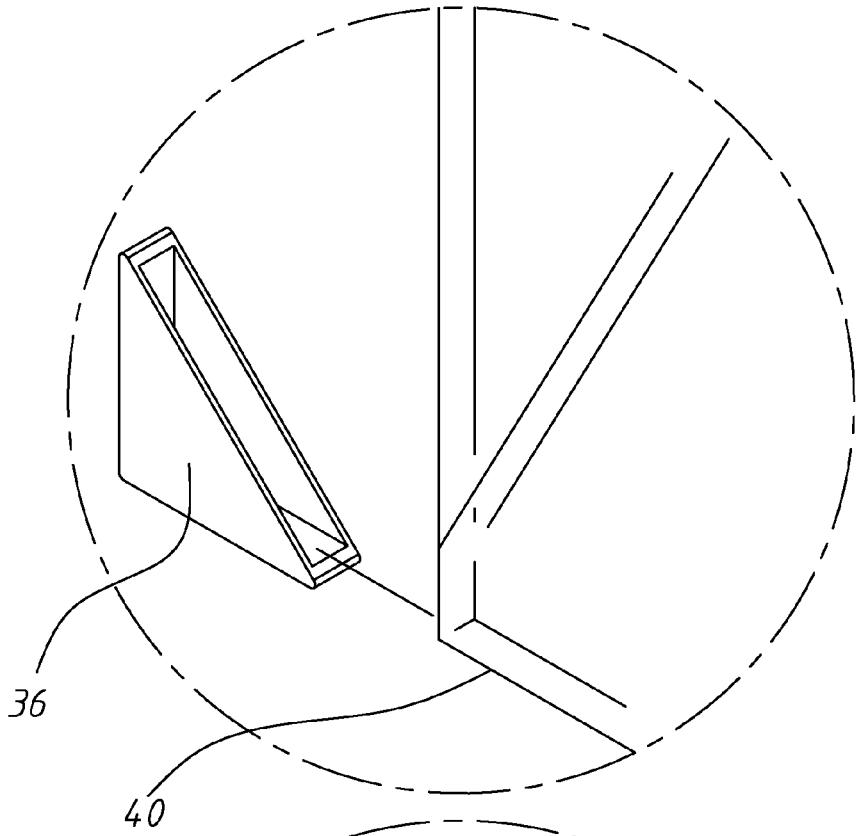
FIG. 7 is a schematic diagram of a buffer element of an improved structure for a packaging and protection device of fragile plates according to an embodiment of the present invention.
Figure 7:
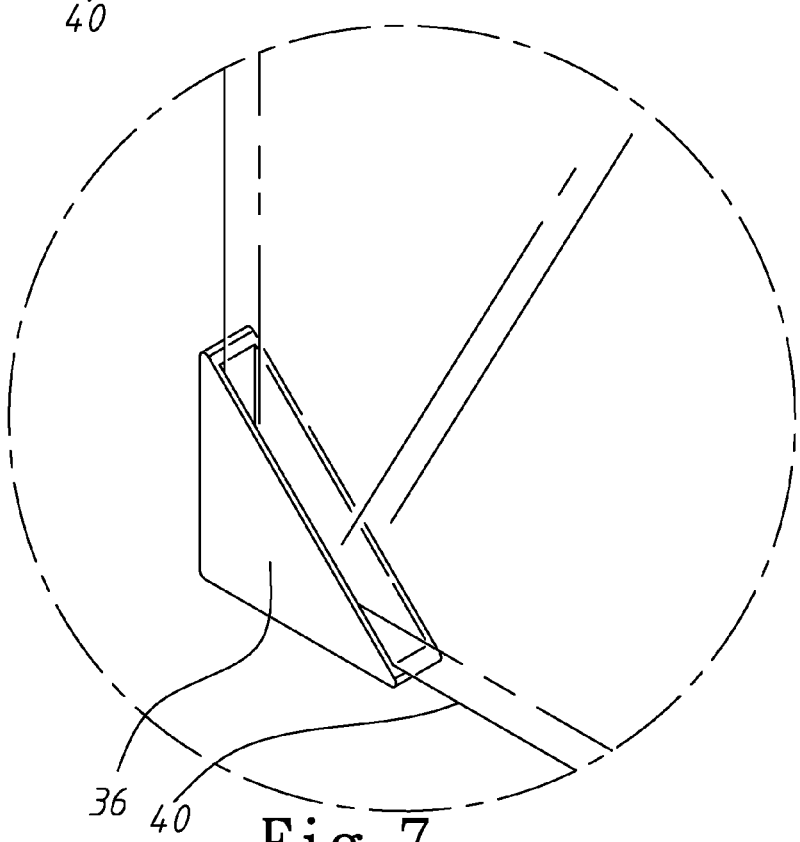

Wherein, the box main body 31 is provided with an accommodating space, and a box cover 32 used to cover and close an opening of the box main body. The bottom plate 33 is provided in the accommodating space of the box main body 31 and is in contact with a bottom portion of the box main body 31. Two first fixing elements 34 are provided in an accommodating space of the box main body 31 face-to-face, and are disposed vertically at the bottom portion of the box main body 31. In addition, two first fixing elements 34 are each provided with a plurality of first fixing slots 341, and each of the bottom portions of a plurality of first fixing slots 341 is provided respectively with embedded slots 38 of a right angle configuration (as shown in FIG. 6). In an embedded slot 38 is provided with a buffer element 36. A plurality of buffer elements 36 are each provided with a gap (as shown in FIG. 7) and are in a configuration of a right-angle triangle, so that corners of a bottom portion of a fragile plate 40 can slide downward along the first fixing slots 341 of two first fixing elements 34 to the gaps of buffer elements 36. Each of the two second fixing elements 35 is also provided with a plurality of second fixing slots 351, and a top portion of each of a plurality of second fixing slots 351 is also provided with an embedded slot 38 in a right angle configuration respectively (as shown in FIG. 6). In an embedded slot 38 is provided with a buffer element 36. When each of the two second fixing elements 35 is installed in an accommodating space of a box main body 31, through the sliding downward of the two sides of a fragile plate 40 along the second fixing slots 351, thus corners of a top portion of a fragile plate 40 are placed in the gaps of the buffer elements 36 of the second fixing slots 351.

Since a buffer element 36 is provided respectively in an embedded slot 38 of a first fixing slot 341 and a second fixing slot 351. Therefore, a bottom surface of a fragile plate 40 is in contact with a bottom plate 33, and both sides of a fragile plate 40 are in close contact with a first fixing slot 341 and a second fixing slot 351.

In addition, a fragile plate packaging and protection device 30 further includes a plurality of positioning strips 37, and each of the plurality of positioning strips 37 is provided with a plurality of positioning slots 371 respectively, such that the positioning strips 37 are placed on a top surface of a box cover 32 and are in contact with the box cover 32. When the box cover 32 is put and closed on a box main body 31, a top surface of a fragile plate 40 is in close contact with a positioning slot 371 of a positioning strip 37 respectively.

Since when a box cover 32 is put and closed on a box main body 31, a bottom surface of a fragile plate 40 is in contact with a bottom plate 33, thus the bottom plate is able to share the gravitation force of a fragile plate. Moreover, since each of the four corners of a fragile plate 40 is placed in a gap of a buffer element 36, so that the fragile plate can be placed stably in the first fixing slots 341 and the second fixing slots 342, hereby overcoming the problem that the gaps of fixing slots are too large to hold a fragile plate stably. Meanwhile, each of the two sides of a fragile plate 40 is in close contact with a first fixing slot 341 or a second fixing slot 342 respectively, thus an upper top surface of a fragile plate is in close contact with a positioning slot 371 of a positioning strip 37, such that when a packaging and protection device is subject to a piling, mounting & dismounting, or transportation process, the vibrations incurred can be reduced, thus the four corners of a fragile plate is protected from being damaged.

Furthermore, a bottom plate 33 of a fragile plate packaging and protection device 30 can also designed into having a plurality of positioning strips (not shown), thus when a fragile plate is positioned stably in a positioning slot of a positioning strip, the gravitation force can also be shared by the positioning slot. Meanwhile, in case that the bottom portion of a first fixing slot and the top portion of a second fixing slot are not provided with embedded slots, then the thickness of a bottom plate and a positioning strip can be increased correspondingly, so that the first positioning slot and the second positioning slot can be in a complete close contact with the top surface and the bottom surface of a fragile plate, hereby avoiding gaps that may lead to the damage of a fragile plate.

In addition, in the present embodiment, one of the major functions of a bottom plate 33, two first fixing elements 34, two second fixing elements 35, and a positioning strip 37 is to share the gravitation force, buffering and absorbing vibrations, thus the material utilized is preferred to be an Extruded Polyethylene (EPE) or an Extruded Polypropylene (EPP), however, the present invention is not limited to this. Meanwhile, in addition to the functions of buffering and absorbing vibrations, a buffer element 36 is used to hold a fragile plate 40 stably in a first fixing slot 341 and a second fixing slot 352, as such, it is preferably made of a plastic material, preferably Polypropylene (PP) material, however, the present invention is not limited to this.

Figure 8:
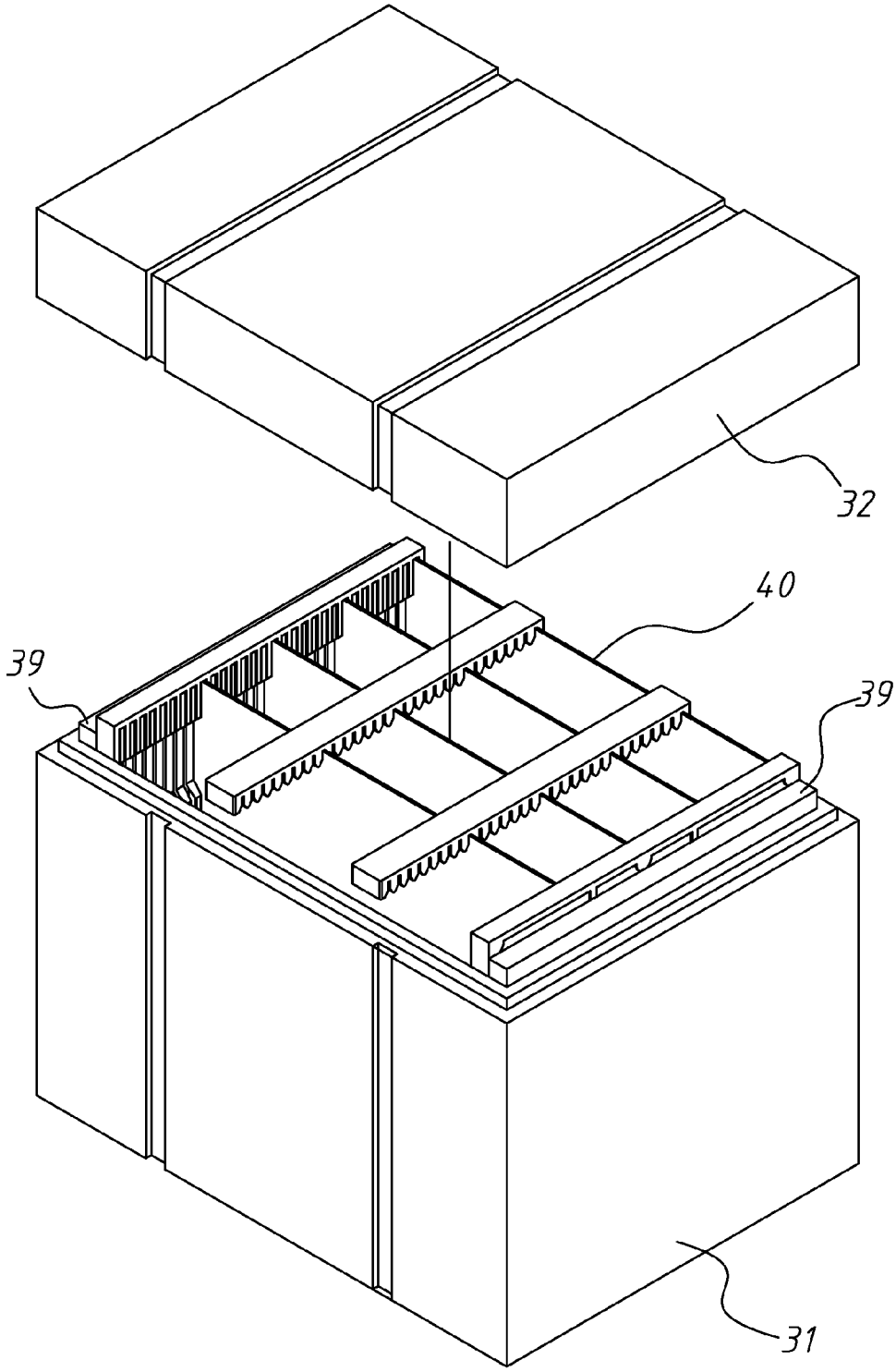
FIG. 8 is a perspective view of an improved structure for a packaging and protection device of fragile plates according to another embodiment of the present invention.

Furthermore, referring to FIG. 8 for an improved structure of a fragile plate packaging and protection device according to another embodiment of the present invention. The assembly principle utilized in the present embodiment is the same as that of the previous embodiment, yet the difference is that the fragile plate packaging and protection device 30 can match and accommodate fragile plates 40 of various sizes. In case that a fragile plate 40 is of a smaller size, then the bottom plate 33 can be designed to be a smaller size, or at least a positioning strip 37 is utilized to match the length of a fragile plate 40, meanwhile, two first fixing elements 34 and two second fixing elements 35 are made to move closer to each other, so that the fragile plate 40 can be held stably in a first fixing slot 341 and a second fixing slot 351. However, when two first fixing elements 34 and two second fixing elements 35 are made to move closer to each other, a gap will be formed between a first fixing element 34, a second fixing element 35, and a box main body 31 respectively, as such, a fragile plate 40 is liable to displace and move during a transportation process and thus be damaged. Therefore, when the size of a fragile plate 40 is smaller such that a first fixing element 34 and a second fixing element 35 can not be in close contact with inner walls of a box main body 31, then a padding element 39 can be used to fill in and pad the gap. The padding element 39 is made of a foaming material, such as Extruded Polyethylene (EPE) or Extruded Polypropylene (EPP), however, the present invention is not limited to this. Therefore, in addition to being able to fix the elements inside a box main body 31, a padding element 39 is also capable of buffering and absorbing shocks and vibrations, thus enhancing the protection effect of a fragile plate packaging and protection device 30.

In addition, in case that the size of a fragile plate 40 is changed to a larger or smaller size in height, so that a fragile plate 40 is higher or lower, namely higher or lower than the original fragile plate, and since the first fixing element 34 and the second fixing element 35 are able to make vertical movements in an up-and-down direction, thus in case that a fragile plate 40 is higher or lower, then up-and-down movements of adjustment can be made through two second fixing elements 35. Naturally, in case that a fragile plate 40 is too high, such that a distance between a first fixing element 34 and a second fixing element 35 is too large, then a connection plate can be added additionally between the first fixing element 34 and the second fixing element 35, so that the fragile plate 40 can have better protection.

Summing up the above, through the application of the present invention, excellent safety, practicality, and economy can be achieved for a packaging and protection device of fragile plates. As such, it is indeed a superior results of creative thinking, thus it is prepared for a patent application. However, the above description is intended merely for presenting Preferred Embodiments of the present invention, and any variations or modifications of the present invention are within the scope of the appended Claims.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. An improved structure for a fragile plate packaging and protection device, comprising:

a box main body, provided with an accommodating space, and a box cover used to cover and close an opening of said box main body;

a bottom plate, provided in said accommodating space of said box main body, and is in contact with a bottom portion of said box main body;

two first fixing elements, provided each with a plurality of first fixing slots, and are placed in said accommodating space face-to-face to each other and are disposed vertically at a bottom portion of said box main body; and two second fixing elements, provided each with a plurality of second fixing slots, and are provided in said accommodating space face-to-face to each other, and are disposed vertically on said two first fixing elements.

2. The improved structure for a fragile plate packaging and protection device as claimed in claim 1, further comprising:

a plurality of buffer elements, provided each with a gap and are embedded in a bottom portion of said first fixing slot and in top portions of said plurality of second fixing slots.

3. The improved structure for a fragile plate packaging and protection device as claimed in claim 1, further comprising:

a plurality of positioning strips, disposed over said fragile plate, and are in close contact with said box cover, each of said plurality of positioning strips is further provided with a plurality of positioning slots used for fixing said fragile plate.

4. The improved structure for a fragile plate packaging and protection device as claimed in claim 1, wherein said bottom plate is composed of said plurality of positioning strips, each of said plurality of positioning strips is further provided with said plurality of positioning slots used for fixing said fragile plate.

5. The improved structure for a fragile plate packaging and protection device as claimed in claim 1, wherein said bottom portion of said first fixing slots and said top portion of said second fixing slots are provided each with an embedded slot, and is used to receive said buffer element respectively.

6. The improved structure for a fragile plate packaging and protection device as claimed in claim 5, wherein said embedded slot is of a right-angle shape.

7. The improved structure for a fragile plate packaging and protection device as claimed in claim 2, wherein said buffer element is of a right-angle triangle configuration.

8. The improved structure for a fragile plate packaging and protection device as claimed in claim 2, wherein said buffer element is made of a plastic material.

9. The improved structure for a fragile plate packaging and protection device as claimed in claim 1, wherein said two first fixing elements and said two second fixing elements can be made to move face-to-face in an accommodating space of said box main body, thus matching the size of said fragile plate.

10. The improved structure for a fragile plate packaging and protection device as claimed in claim 1, further comprising:

two padding elements, that are placed in gaps between said first fixing element, said second fixing element, and said box main body, thus matching a smaller-sized fragile plate.

* * * * *